US008167579B2

(12) United States Patent
Schultz et al.

(10) Patent No.: US 8,167,579 B2
(45) Date of Patent: May 1, 2012

(54) AIR COMPRESSOR ASSEMBLY INCLUDING DETACHABLE TOOL STORAGE BIN

(75) Inventors: Joseph Schultz, Anderson, SC (US); William Sadkowski, Anderson, SC (US); Andrew Camardella, Cockeysville, MD (US); Adam Gathers, Anderson, SC (US); Thomas Parel, Anderson, SC (US); Taku Ohi, Greer, SC (US); Richard L. Strack, Anderson, SC (US); Christopher Scott Tennant, Clemson, SC (US)

(73) Assignee: Techtronic Power Tools Technology Limited, Tortola (VG)

( * ) Notice: Subject to any disclaimer, the term of this patent is extended or adjusted under 35 U.S.C. 154(b) by 810 days.

(21) Appl. No.: 12/264,678

(22) Filed: Nov. 4, 2008

(65) Prior Publication Data

US 2010/0111717 A1 May 6, 2010

(51) Int. Cl.
*F04B 53/00* (2006.01)

(52) U.S. Cl. ..... 417/234; 417/313

(58) Field of Classification Search ..... 417/234, 417/313, 572

See application file for complete search history.

(56) References Cited

U.S. PATENT DOCUMENTS

| | | | | |
|---|---|---|---|---|
| 6,065,942 | A * | 5/2000 | Glidden et al. | 417/236 |
| 6,146,108 | A * | 11/2000 | Mullendore | 417/234 |
| D500,052 | S * | 12/2004 | Lucchi | D15/9 |
| 7,384,245 | B2 * | 6/2008 | Hernandez et al. | 417/234 |
| 2003/0039557 | A1 * | 2/2003 | Burford et al. | 417/234 |
| 2005/0196290 | A1 * | 9/2005 | Hu | 417/234 |
| 2006/0104825 | A1 | 5/2006 | Etter et al. | |
| 2006/0104835 | A1 * | 5/2006 | Etter et al. | 417/410.1 |
| 2006/0104837 | A1 | 5/2006 | Lee et al. | |
| 2007/0122292 | A1 | 5/2007 | Etter et al. | |
| 2007/0212233 | A1 * | 9/2007 | Chang et al. | 417/234 |
| 2007/0217924 | A1 * | 9/2007 | Bass et al. | 417/234 |

FOREIGN PATENT DOCUMENTS

| | | |
|---|---|---|
| JP | 2002285967 | 10/2002 |
| WO | 2006037118 A2 | 4/2006 |
| WO | 2006037118 A3 | 4/2006 |

OTHER PUBLICATIONS

EP 09252486.7 Extended European Search Report dated Mar. 18, 2011 (9 pages).

* cited by examiner

*Primary Examiner* — Peter Macchiarolo
*Assistant Examiner* — Glenn Zimmerman
(74) *Attorney, Agent, or Firm* — Michael Best & Friedrich LLP

(57) ABSTRACT

An air compressor assembly is disclosed. The air compressor assembly includes a substantially curved frame including a lower frame portion and an upper frame portion, a fluid tank carried by the lower frame portion, a compressor mechanism carried by the lower frame portion, and a storage bin including an engagement mechanism releasably coupled to the upper frame portion.

15 Claims, 12 Drawing Sheets

AIR COMPRESSOR ASSEMBLY INCLUDING DETACHABLE TOOL STORAGE BIN

TECHNICAL FIELD

The present disclosure generally relates to air compressors, and more specifically to portable air compressor assemblies that include a removable storage bin.

BACKGROUND

Air compressors and more specifically portable air compressor assemblies are often utilized at multiple job sites and/or at multiple locations around a single job site. Known air compressor assemblies are often configured to be carried or rolled to a desired job site or location within a job site. When moving between job sites or locations within the job site, it is often necessary to transport compressor accessories or components, such as hoses or nozzles, power tools which may be driven by the compressor and/or other suitable construction materials. Often different jobs require different tools. For example, roofers and carpenters may utilize several different types of nail guns depending upon the type of project on which they are working. Other skilled trades may utilize, for example, impact wrenches, paint sprayers or blowers.

U.S. Patent Published Application No. 2007/0122292 discloses an air compressor assembly that includes a support structure with a compressor mechanism, at least one fluid tank, a pair of wheels, and a handle attached thereto. The air compressor assembly is configured with the compressor mechanism having a perpendicular orientation relative to the at least one fluid tank so as to provide a relatively narrow assembly and to facilitate servicing and/or maintenance of the assembly. An accessory support plate can be attached to the top of the assembly to serve as a dolly.

SUMMARY

The present disclosure provides an air compressor assembly that includes a compressor mechanism preferably positioned and arranged in a transverse manner relative to a fluid tank. The compressor mechanism and the fluid tank may be secured by or supported within a roll-cage or frame. In particular, the roll-cage or frame may be a substantially "C" shaped frame that includes an upper frame portion and a lower frame portion. Thus, the compressor mechanism and the fluid tank may be secured within and protected by the upper and lower frame portions of the frame. The air compressor assembly may further include a container or storage bin configured to cooperate with the upper frame portion of the frame. For example, the container or storage bin may include an engagement mechanism configured to deformably engage the upper frame portion of the frame. The container or storage bin may further include one or more compartments, modules or trays for storing tools, compressor accessories, a take-up reel assembly or other parts and accessories.

In one embodiment, an air compressor assembly is disclosed. The air compressor assembly includes a frame having a lower frame portion and an upper frame portion, a fluid tank carried by the lower frame portion, a compressor mechanism carried by the lower frame portion, and a storage bin including an engagement mechanism, wherein the engagement mechanism is releasably coupled to the upper frame portion.

In another embodiment, an air compressor assembly having a frame including a lower frame portion and an upper frame portion, a fluid tank carried by the lower frame portion, and a compressor mechanism carried by the lower frame portion,. The air compressor assembly includes a storage bin releasably coupled to the upper frame portion and including an engagement mechanism disposed on a bottom portion of the storage bin, wherein the engagement mechanism is configured to releasably engage the upper frame portion, a storage compartment having a lid pivotable attached to a back wall of the storage bin, and a hose-reel support having a take-up real assembly rotatably attached to adjacent to a side wall of the storage bin.

In another embodiment, a storage bin configured to be releasably coupled to an upper frame portion of a compressor assembly is disclosed. The storage bin includes an engagement mechanism disposed on a bottom portion of the storage bin, wherein the engagement mechanism is configured to releasably engage the upper frame portion, a storage compartment having a lid pivotable attached to a back wall of the storage bin, and a removable wall carried within the storage compartment, wherein the removable wall is configured to is configured to divide the storage compartment into at least two sub-compartments.

Other embodiments are disclosed, and each of the embodiments can be used alone or together in combination. Additional features and advantages of the disclosed embodiments are described in, and will be apparent from, the following Detailed Description and the figures.

DETAILED DESCRIPTION

The present disclosure provides an exemplary air compressor assembly in which a pump or compressor mechanism may be positioned and secured perpendicular to at least one fluid tank. The air compressor assembly may include a frame configured to support and protect the compressor mechanism and the fluid tank in a roll-cage. The air compressor assembly may further include a container or storage bin configured to cooperate with an upper frame portion of the frame. For example, the container or storage bin may include an engagement mechanism configured to deformably engage the upper frame portion of the frame. The container or storage bin may further include one or more compartments, modules or portions for storing tools, compressor accessories, a take-up reel assembly, or other parts and accessories.

Figure 1:
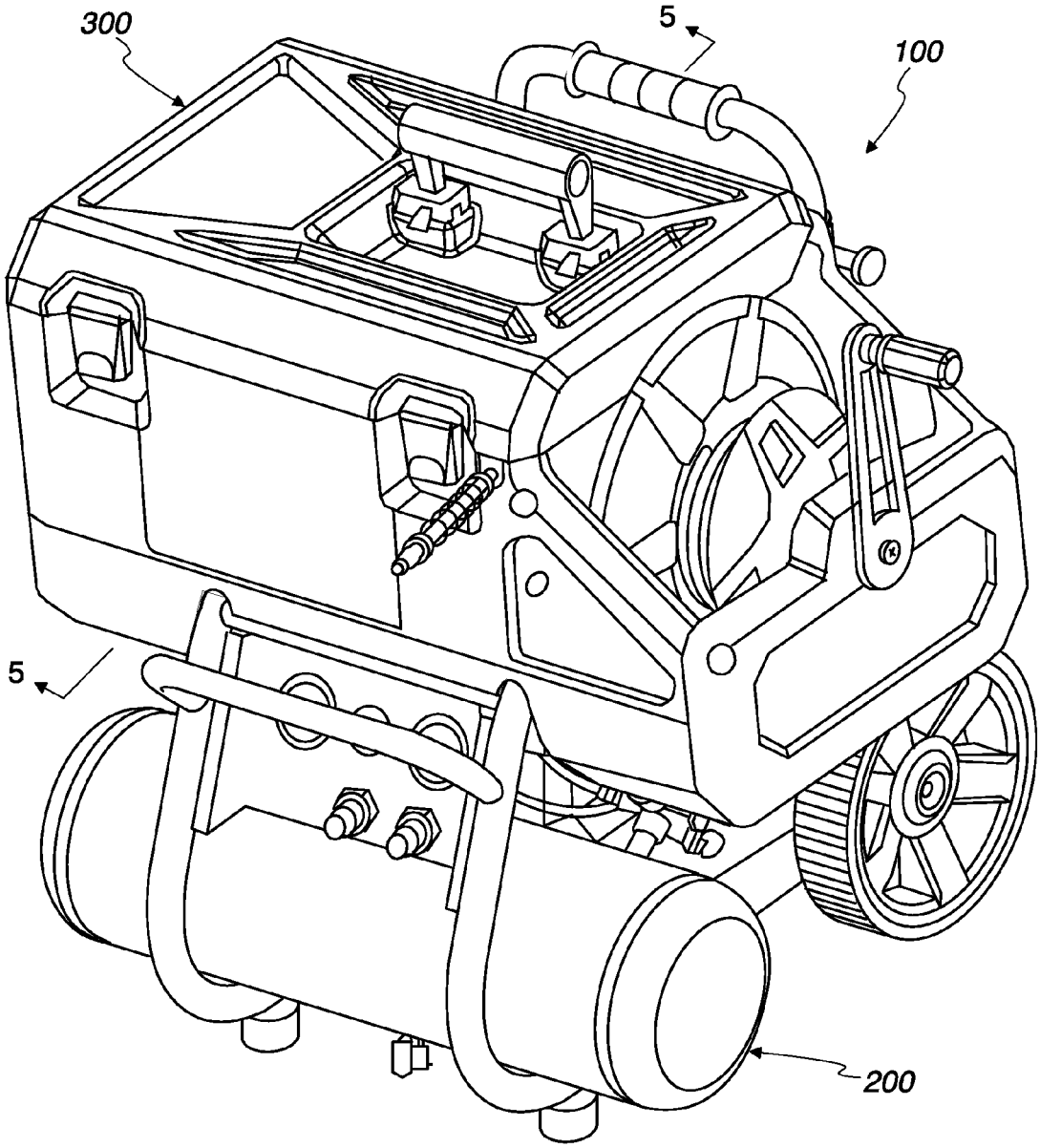
FIG. 1 illustrates a perspective view of a compressor assembly and storage bin constructed in accordance with the disclosure presented herein.

FIG. 1 illustrates an exemplary embodiment of a portable compressor assembly 100 configured in accordance with the disclosure presented herein. The compressor assembly 100, in this exemplary embodiment, includes a storage bin 300 cooperatively engaged with and/or supported by a portable compressor unit 200.

Figure 2:
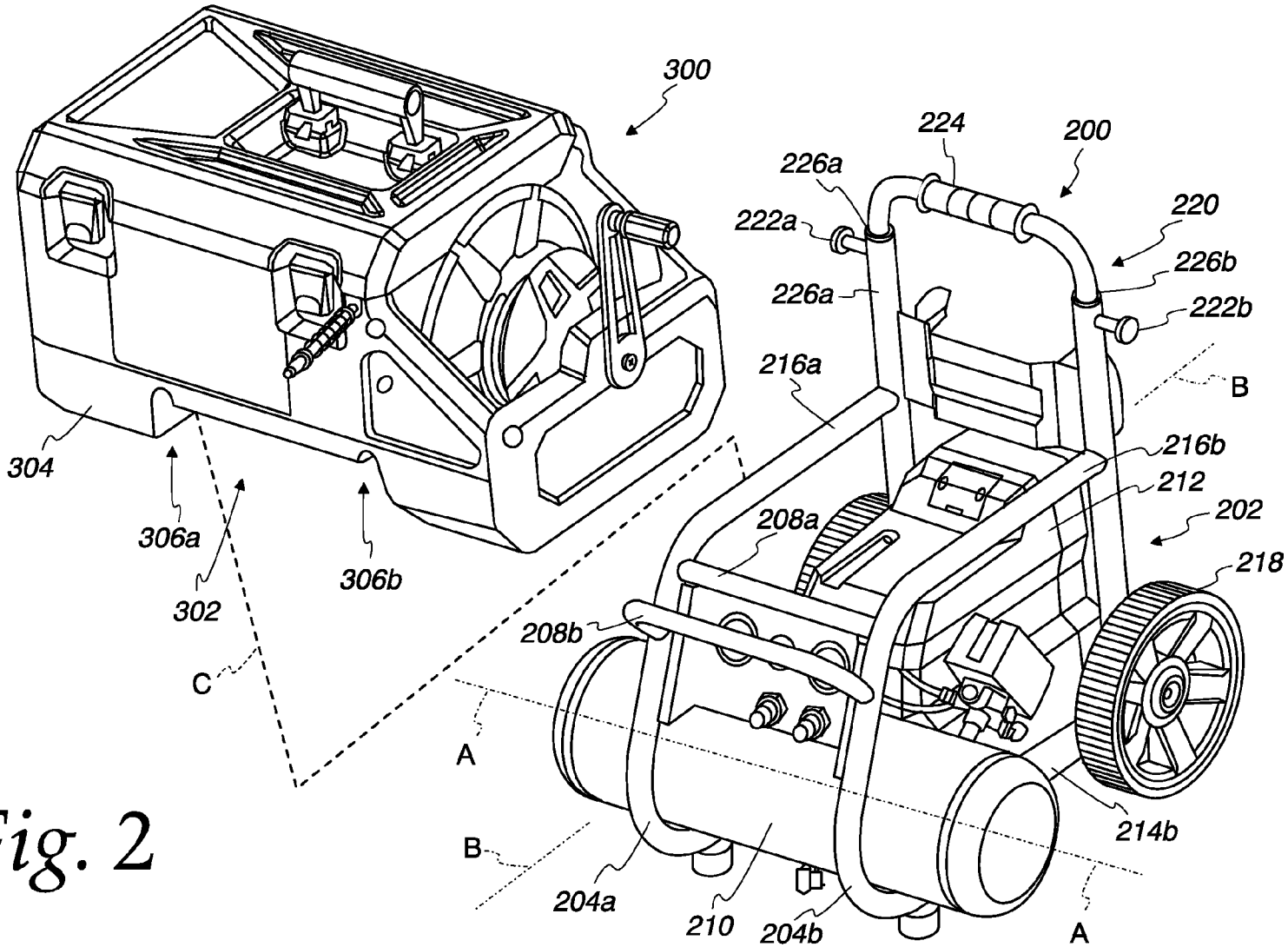
FIG. 2 illustrates an exploded perspective view of the compressor assembly and storage bin shown in FIG. 1.

FIG. 2 illustrates an enlarged perspective view of the compressor unit 200 arranged to receive or detachably support the storage bin 300. The compressor unit 200 may include a tubular frame or frame 202. The frame 202 may, in turn, include a first frame member 204*a* and a second frame member 204*b*. The first and second frame members 204*a*, 204*b* may be substantially curved or C-shaped members arranged such that the each of the open ends are attached to and supported by vertical members 206*a*, 206*b*, respectively. A cross-brace 208*a* may provide additional support and stability between the first and second frame members 204*a*, 204*b*. A second cross-brace 208*b* may be configured to function as a lifting handle or member. The lifting handle or cross-brace 208*b* may cooperate with a telescoping handle 220 (see FIGS. 2 and 3) adjustably carried within the vertical members 206*a*, 206*b*. The telescoping handle 220, including a handle 224 extending between vertical legs 226*a*, 226*b*, may be utilized in the stored position (as shown) in cooperation with the lifting handle or cross-brace 208*b* to lift or move the portable compressor assembly 100.

The telescoping handle 220 may be secured, for example, in the stored position (as shown) or extended position (see FIG. 3) utilizing a locking mechanism or means such as a pair of indexed plunger assemblies 222*a*, 222*b* (discussed in greater detail in connection with FIGS. 3A and 3B) cooperatively coupled to vertical members 206*a*, 206*b*. The indexed plunger assemblies 222*a*, 222*b* may selectively lock and/or release to allow the telescoping handle 220 to be positioned in the stored position (as shown) or an extended position (see FIG. 3).

A fluid or compressor tank 210 may be supported between the first and second frame members 204*a*, 204*b*. In the particular embodiment, the fluid tank 210 may include a longitudinal tank axis A arranged substantially perpendicular to the first and second frame members 204*a*, 204*b* and parallel to the plane defined by the vertical members 206*a*, 206*b*.

A pump or compressor mechanism 212 may be supported between, and parallel to, the first and second frame members 204*a*, 204*b*. In the particular embodiment, the compressor mechanism 212 may include a longitudinal compressor axis B arranged substantially parallel to the first and second frame members 204*a*, 204*b* and perpendicular to the plane defined by the vertical members 206*a*, 206*b*. In this configuration, the compressor mechanism 212 is arranged perpendicular to the fluid tank 210. The frame 202, thus configured, may act as a roll-cage to support and protect the components of the compressor assembly 100 mounted therein.

The first and second frame members 204*a*, 204*b* may include lower frame portions 214*a* (see FIG. 3), 214*b*. It will be understood, that the lower frame portions 214*a*, 214*b* may support and carry, for example, the fluid tank 210 and/or the compressor mechanism 212. A pair of wheels 218 may be mounted substantially adjacent to the intersection of the lower frame portions 214*a*, 214*b* and the vertical members 206*a*, 206*b*.

FIG. 2 further illustrates an exploded perspective view of the compressor unit 200 arranged to receive or detachably support the storage bin 300. The storage bin 300 can be removed or detached from the compressor unit 200 without the use of tools or other additional equipment. For example, an engagement mechanism 302 such as a tool-free engagement mechanism may be integrally formed into a bottom wall or surface 304 of the storage bin 300. Alternatively, the engagement mechanism 302 may be a separate component secured or attached to the bottom wall 304. In yet another alternative, the engagement mechanism 300 may include clips, latches and/or snap configured to removably engage upper frame portions 216*a*, 216*b*.

The engagement mechanism 302 may include a pair of grooved or channel-shaped engagement members 306*a*, 306*b* sized to cooperatively and releasably couple to the storage bin 300. The engagement member 306*a* may align, as indicated by the dashed alignment line C, with the upper frame portion 216*a*. Similarly, the engagement member 306*b* may align with the upper frame portion 216*b*. In order to assemble or mate the storage bin 300 to the compressor unit 200, the engagement members 306*a*, 306*b* may be aligned over the upper frame portions 216*a*, 216*b*, respectively. Application of a downward force (i.e., a force pushing towards the compressor unit 200) on the storage bin 300 may cause a temporary deformation of the engagement mechanism 302 thereby allowing the engagement members 306*a*, 306*b* to engage and cooperate with the upper frame portions 216*a*, 216*b* to create a secure fit. Subsequently, an upward force (i.e., a force pulling away from the compressor unit 200) may cause the engagement members 306*a*, 306*b* to briefly deform and release the upper frame portions 216*a*, 216*b* thereby allowing the storage bin 300 to separate from the compressor unit 200. The storage bin 300 may, for example, include one or more handles or hand grip portions to facilitate tool-less engagement and disengagement from the compressor unit 200.

Figure 3:
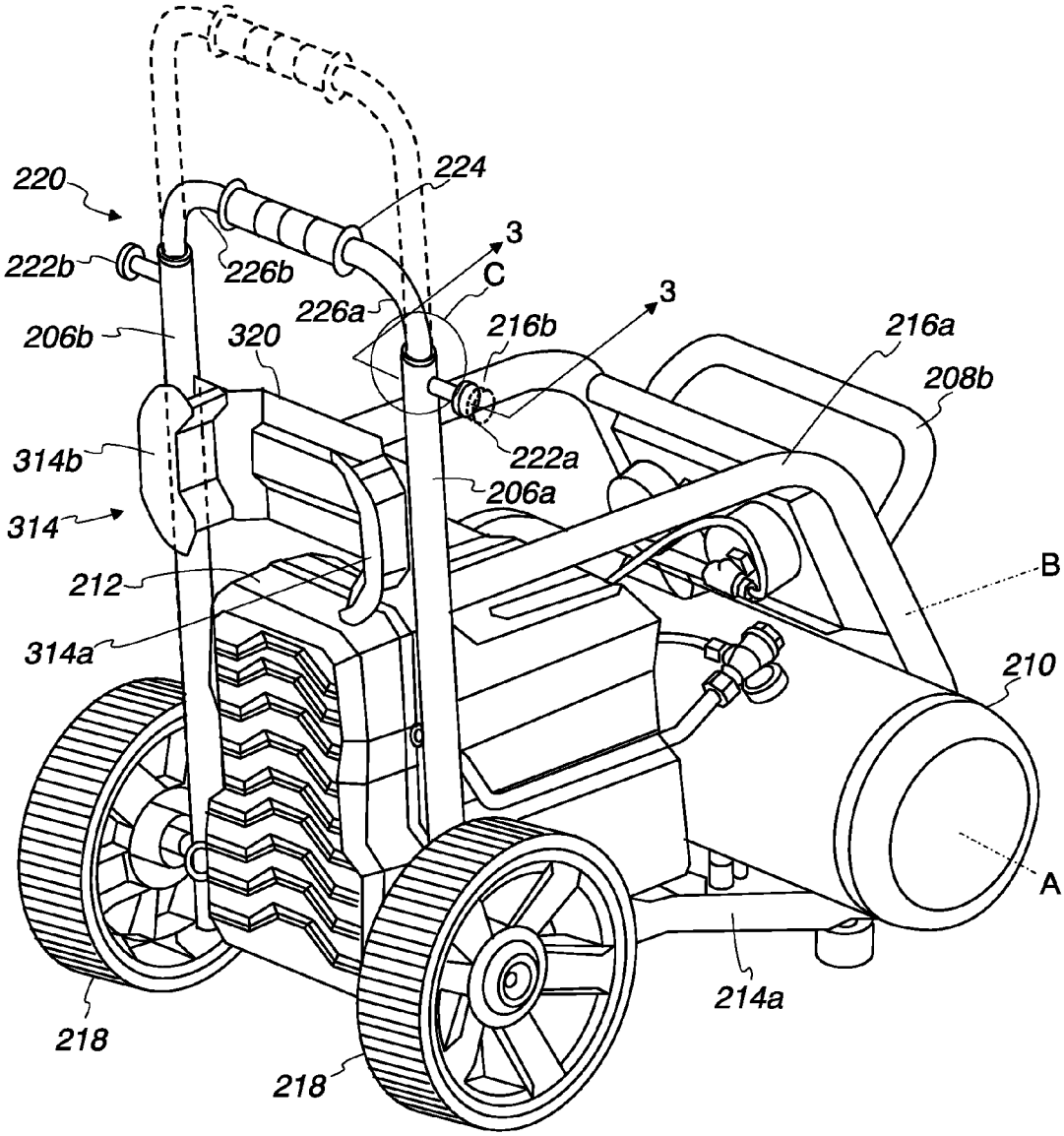
FIG. 3 illustrates a perspective view of the rear of the compressor assembly shown in FIG. 1.

FIG. 3 illustrates an enlarged reverse perspective view of the compressor unit 200 arranged to receive or detachably support the storage bin 300. FIG. 3 further illustrates the telescoping handle 220 in a deployed position and further illustrates a cord wrap 314 including wrap members 314*a*, 314*b*. The cord wrap 314 allows cord, tubing or other to be wrapped and stored adjacent to the vertical members 206*a*, 206*b* and the telescoping handle 220.

Figure 3B:
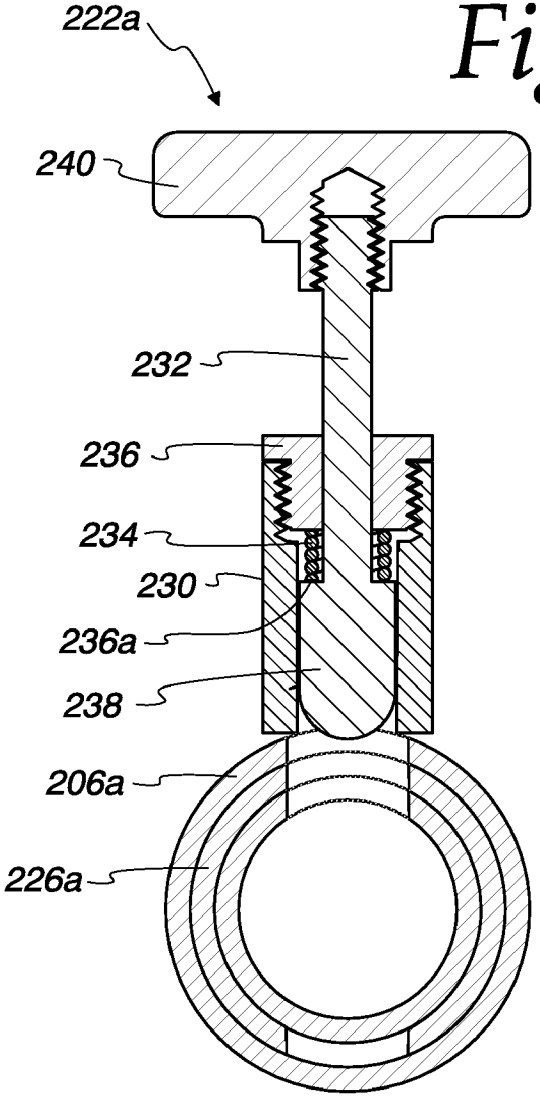
FIGS. 3A and 3B illustrate enlarged views of the call-out C, in section taken along the line 3-3, detailing a locking portion of the handle assembly shown in FIG. 3.
Figure 3A:
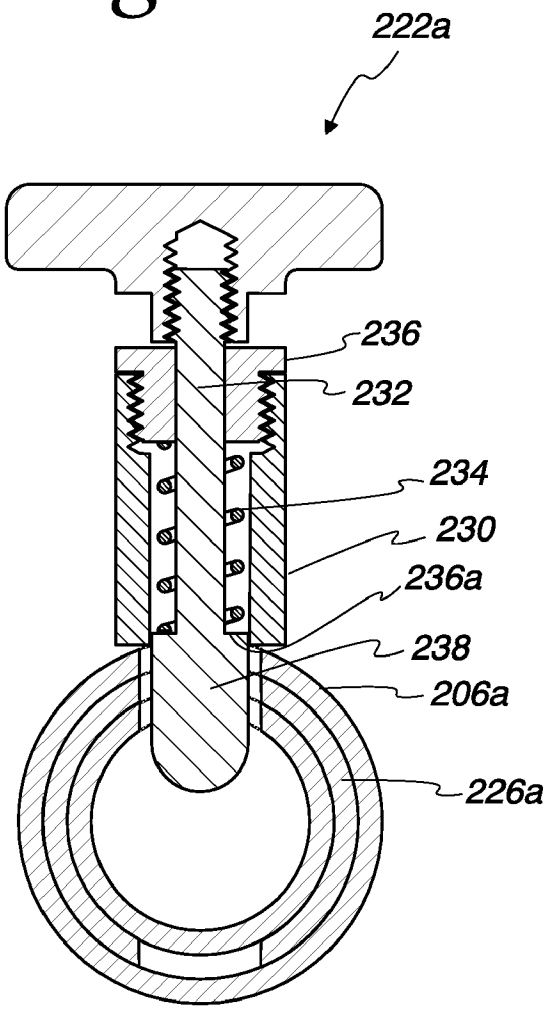

FIGS. 3A and 3B are enlarged sectional views taken along the section line 3-3 shown within the call-out C of FIG. 3. FIG. 3A illustrates the indexed plunger assembly 222*a* cooperating with the vertical leg 226*a* and the vertical member 206*b* to releasably secure and/or lock the telescoping handle 220 in a desired position. The indexed plunger assembly 222*a*, in this exemplary embodiment, includes an indexed plunger housing 230 cooperatively coupled or affixed to the vertical member 206*a*. The plunger housing 230 encloses and contains an indexed plunger 232 biased towards an engaged position by a spring 234. For example, the spring 234 acts against a plug 236 carried within the plunger housing 230 and a step portion 236*a* of the indexed plunger 232. In this manner, the spring 234 encourages a head portion 238 of the indexed plunger 232 to contact and cooperate with the vertical leg 226*a* and the vertical member 206*a*. In particular, because both the indexed plunger 232 and the vertical member 206*a* are fixed relative to the vertical leg 226*a*, the vertical leg 226*a* is held in a fixed position when the head portion 238 is engaged.

FIG. 3B illustrates the indexed plunger assembly 222*a* disengaged from the vertical leg 226*a* and the vertical member 206*b* to allow movement of the telescoping handle 220 to a desired position. For example, a user may grasp and pull a knob or handle 240 to overcome the biasing force provided by the spring 234 and slideably extract the indexed plunger 232 from the vertical leg 226*a* and the vertical member 206*a*. By pulling and compressing the spring 234, the indexed plunger 232 can be disengaged from the vertical leg 226*a*. The indexed plunger 232 and the head portion 238 may include a flat surface (not shown) alignable with a mating flat surface (not shown) provided in the vertical leg 226*a* such that a slight twist of the knob 240 can change the relative alignment of the two components and prevent unintentional reengagement of the indexed plunger assembly 222*a*. When engagement is desired, a second twist (back to the original orientation) aligns the flat surface (not shown) of the head portion 238 to the flat surface (not shown) of the vertical leg 226*a* in a keyed or mating arrangement. The spring 234 may, in turn, apply a force to the step portion 236*a* to encourage cooperation between the indexed plunger 232, the vertical leg 226*a* and the vertical member 206*a*. In this way, the indexed plunger 232 may be adjusted using a single hand to control the engagement of the indexed plunger assembly 222*a*. While FIGS. 3A and 3B discuss the indexed plunger assembly 222*a*, it will be understood that the indexed plunger assembly 222*b* may be configured in a similar fashion to allow one hand operation.

Figure 3C:
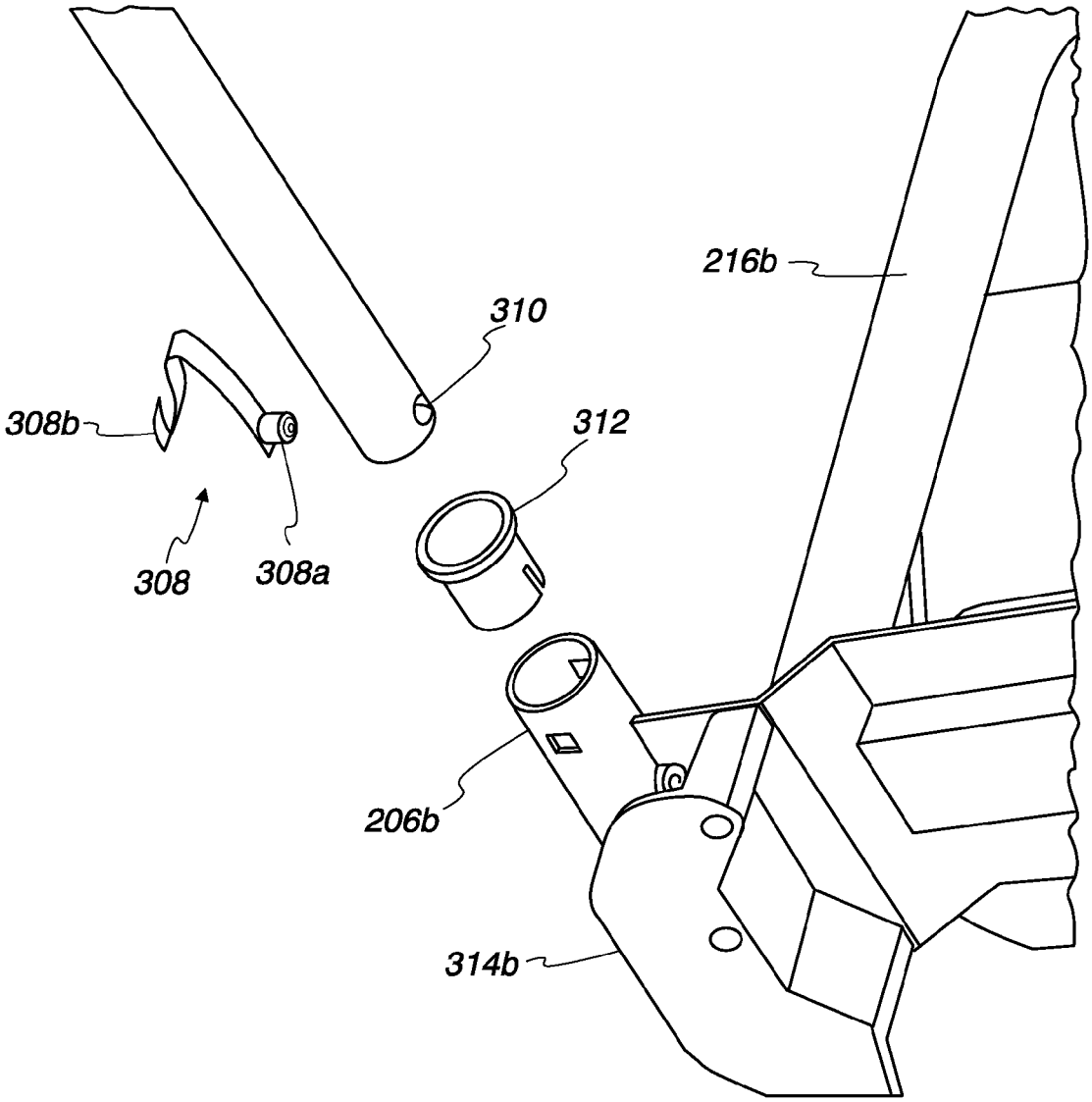
FIG. 3C illustrates an enlarged exploded perspective view of the call-out C detailing an alternate locking portion of the handle assembly shown in FIG. 3.

FIG. 3C is an enlarged exploded view of an alternate embodiment that may be utilized in place of, or in connection with, the indexed plunger assemblies 222*a*, 222*b*. For example, each of the vertical members may include a leaf spring 308 having a detent 308*a* and a positioning tab 308*b* which may be positioned within the slideable vertical legs 226*a*, 226*b* to secure the telescoping handle 220 in the deployed position. For example, the leaf spring 308 may be captured within the interior of the vertical legs 226*a*, 226*b* such that the positioning tab 308*b* presses against an inner surface of the interior while the detent 308*a* passes through and cooperates with a locking hole 310 provided within each of the vertical legs 226*a*, 226*b*. Similar locking holes (not shown) may be provided at different positions within the vertical members 206*a*, 206*b*. In operation, the detent 308*a*, which may be positioned by the flexing action of the leaf spring 308, may cooperate with the locking hole 310 and one of the locking holes (not shown) provided in the vertical members 206*a*, 206*b*. In this way, the telescoping handle 220 may be secured in a predetermined vertical position. By depressing the detent 308*a*, it may disengage from the locking hole (not shown) provided within the vertical members 206*a*, 206*b*, thereby allowing the telescoping handle 220 to repositioned or moved vertically to a different locking hole (not shown) provided within the vertical members 206*a*, 206*b*. A collar 312 may be carried within the vertical members 206*a*, 206*b* to prevent the telescoping handle 220 from being separated or removed accidentally.

Alternatively, a rotatable and or threaded collet may be utilized to secure the telescoping handle 220 in a desired position. For example, one or more threaded collets (not shown) may be secured within the ends of the vertical members 206*a*, 206*b*. Rotation of one or more of the threaded collets relative to the slideable vertical legs 226*a*, 226*b* may secure the telescoping handle 220 in a desired position.

FIG. 3 further illustrates a bracket 320 carried between the vertical members 206*a*, 206*b*. The bracket 320 may cooperate with a receiving member 322 (see FIGS. 4 and 5) carried on a back surface 324 of the storage bin 300. In operation, when the engagement mechanism 302 removably engages or cooperates with the upper frame portions 216*a*, 216*b*, the receiving member 322 (as illustrated in the sectional view shown in FIG. 5) may rigidly engage the bracket 320 to prevent the storage bin 300 from sliding and/or tilting relative to the compressor unit 200.

Figure 4:
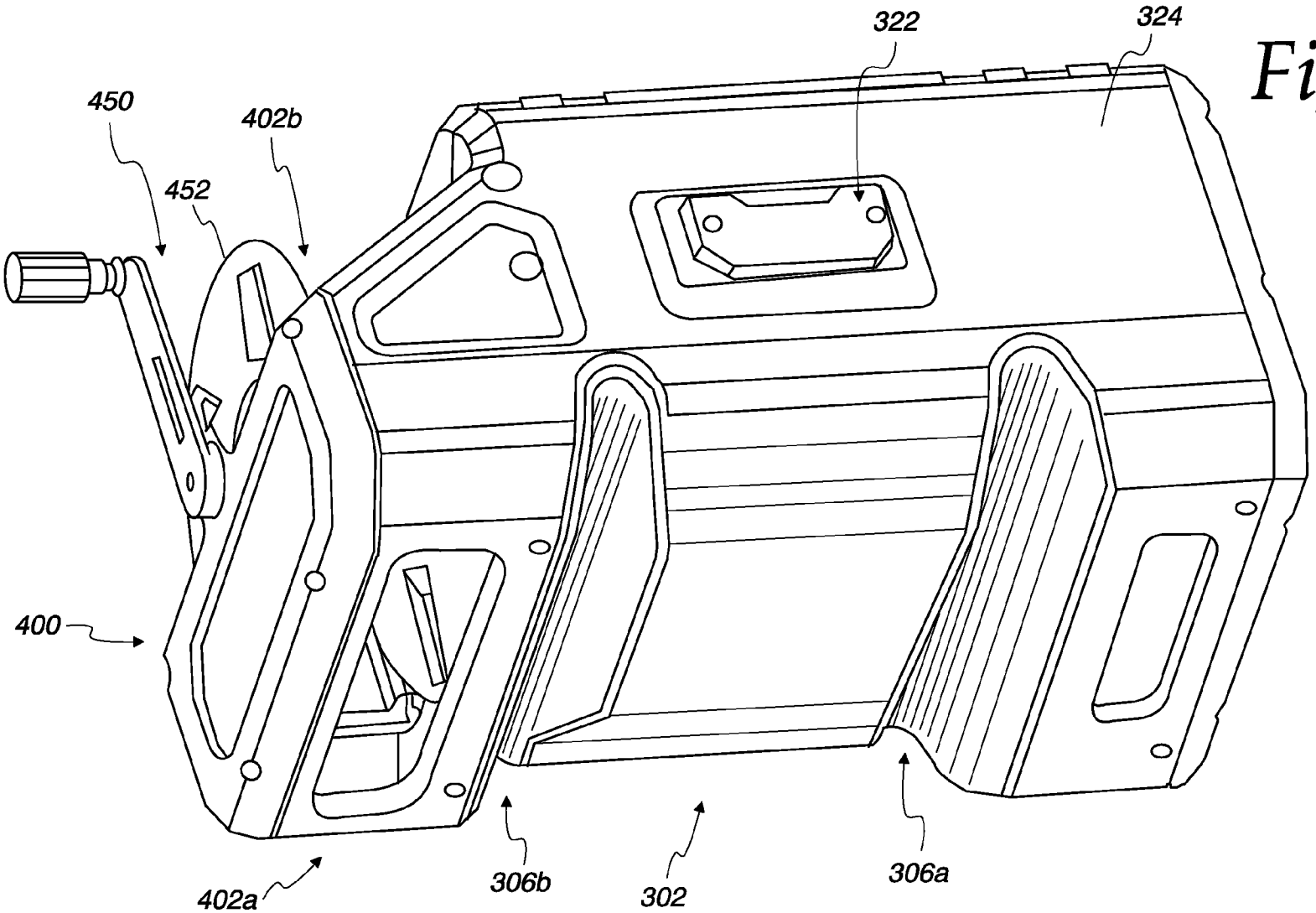
FIG. 4 illustrates a perspective view of the rear and bottom of the storage bin shown in FIG. 1.
Figure 5:
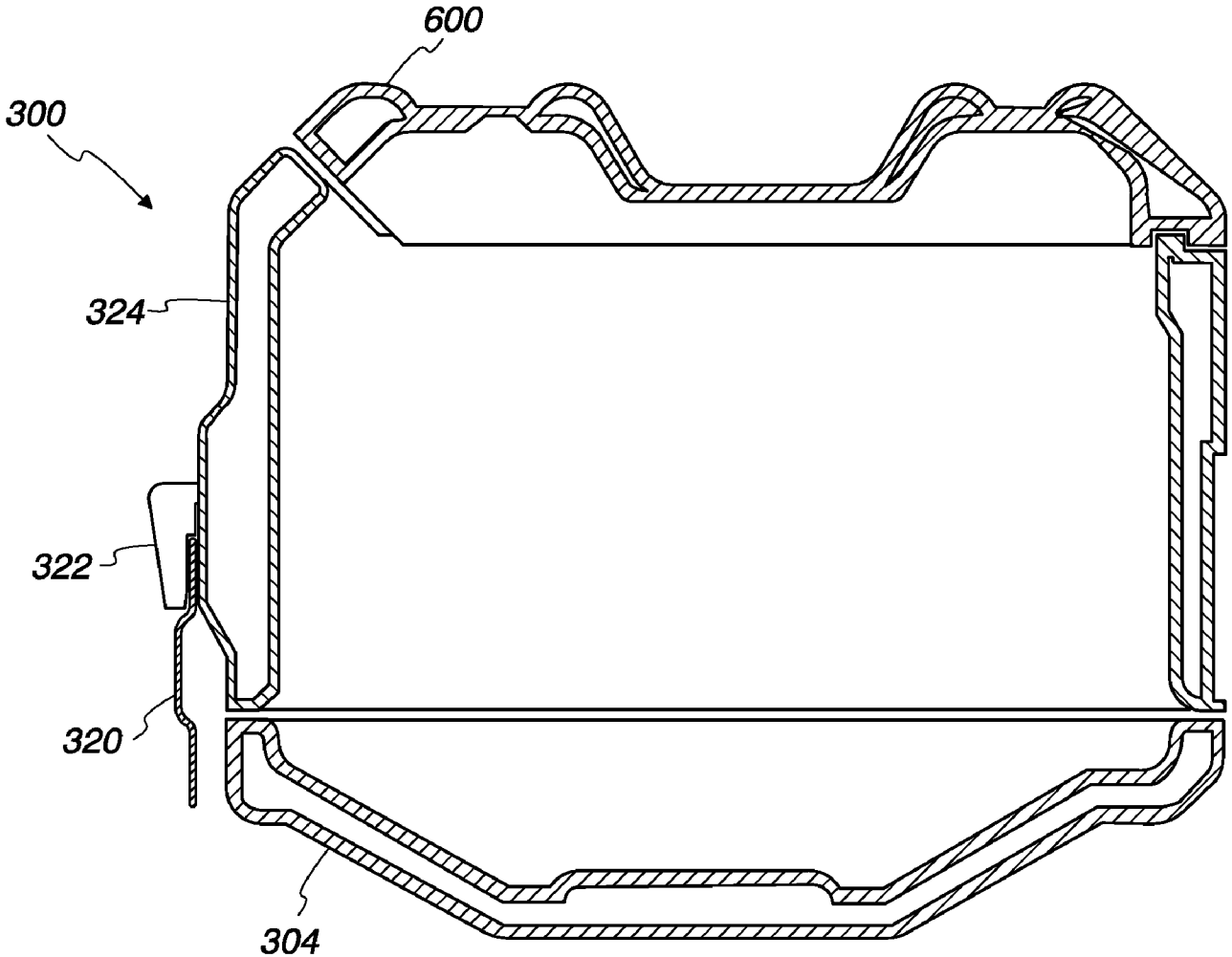
FIG. 5 illustrates a side elevation view, in section taken along the line 5-5 of FIG.1, detailing the engagement between the bracket carried by the compressor assembly and the bracket receiver carried by the storage bin in order to limit the removal of the storage bin from the compressor assembly.

FIG. 4 illustrates a bottom perspective view of the storage bin 300 showing the engagement mechanism 302 and associated engagement members 306*a*, 306*b*. The storage bin 300, in this exemplary embodiment, includes a hose reel support 400 sized to engage and carry a take-up reel assembly 450. The hose reel support 400 is configured to be accessible via both a bottom opening 402*a* and a top opening 402*b*. In this way, any hose 606 (see FIG. 6) or cable carried by a take-up reel 452 of the take-up reel assembly 450 may be accessible via both the bottom opening 402*a* or the top opening 402*b* depending on the application or task being performed. Advantageously, feeding any hose 606 or cable carried by the take-up reel assembly 450 through the bottom opening 402*a* cooperates with gravity and may help to maintain a tighter coil around the take-up reel 452.

Figure 6:
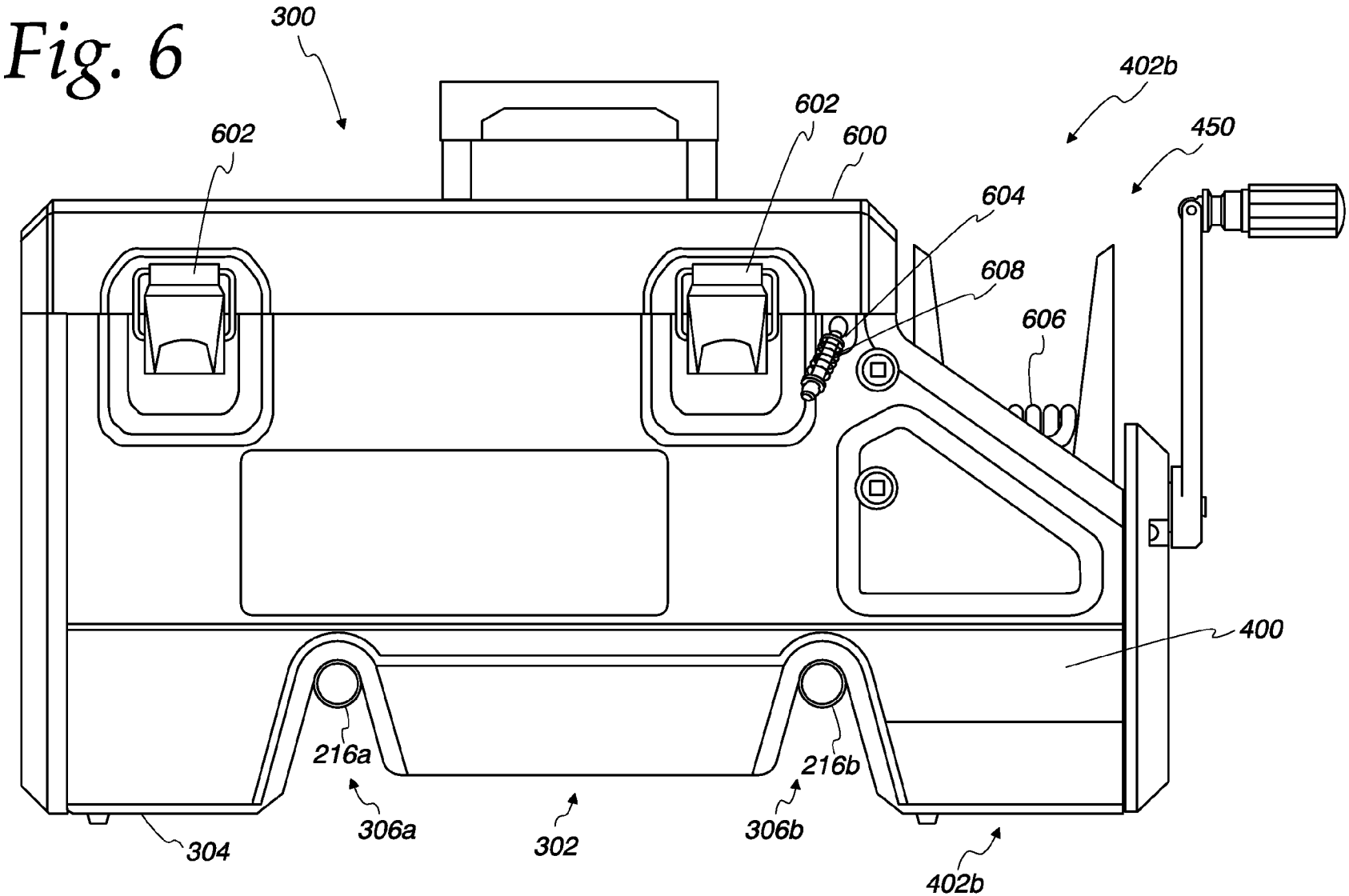
FIG. 6 illustrates a front view of the storage bin configured for cooperation with the compressor assembly shown in FIGS. 1 and 2.

FIG. 6 illustrates a side view of the exemplary storage bin 300 that includes the integral engagement mechanism 302. In this exemplary embodiment, the storage bin 300 may be manufactured via a blow molding process as a substantially complete unit that includes the engagement mechanism 302. Alternatively, the individual sides, walls and/or components of the storage bin 300 may be manufactured separately and assembled to form a completed unit. Assembly may involve any known manufacturing or assembly techniques such as, but not limited to, sonic welding and joining of the individual components, riveting or otherwise fastening the individual components and/or the individual components may be manufactured with complimentary male/female attachment mechanism.

The engagement mechanism 302 and the included engagement members 306*a*, 306*b*, as previously discussed, may be sized to engage the upper frame portions 216*a*, 216*b*. For example, the distance between the engagement members 306*a*, 306*b* may be slightly less than or greater than (e.g., one to three percent (1% to 3%)) the distance between the upper frame portions 216*a*, 216*b* thereby allowing an interference fit to be created therebetween. The degree of the interference fit may be adjusted based on the desired amount of force necessary to couple/decouple the storage bin 300 from the compressor unit 200.

Figure 7:
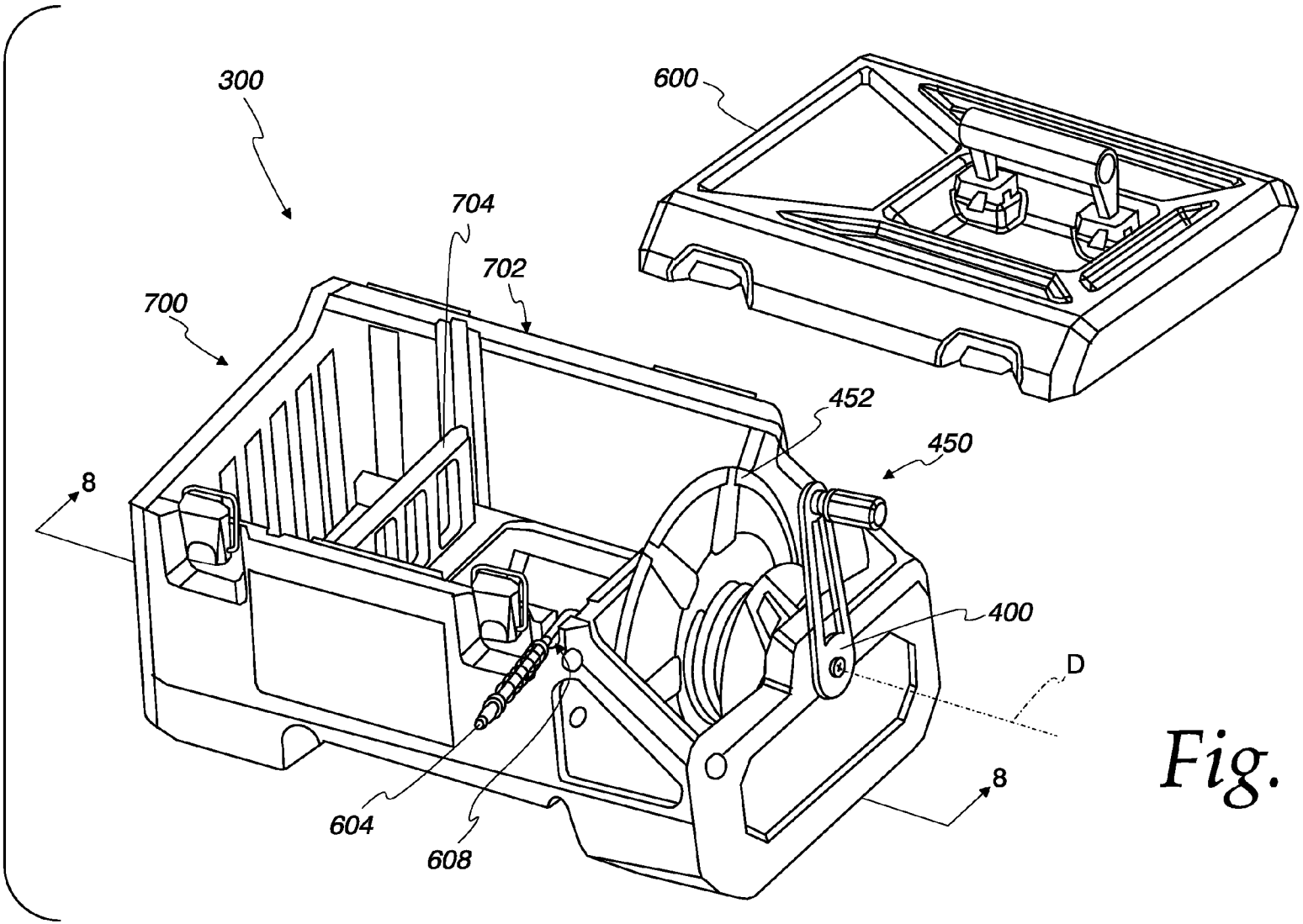
FIG. 7 illustrates a perspective view of the storage bin shown in FIGS. 1 and 7 with a lid removed.
Figure 8:
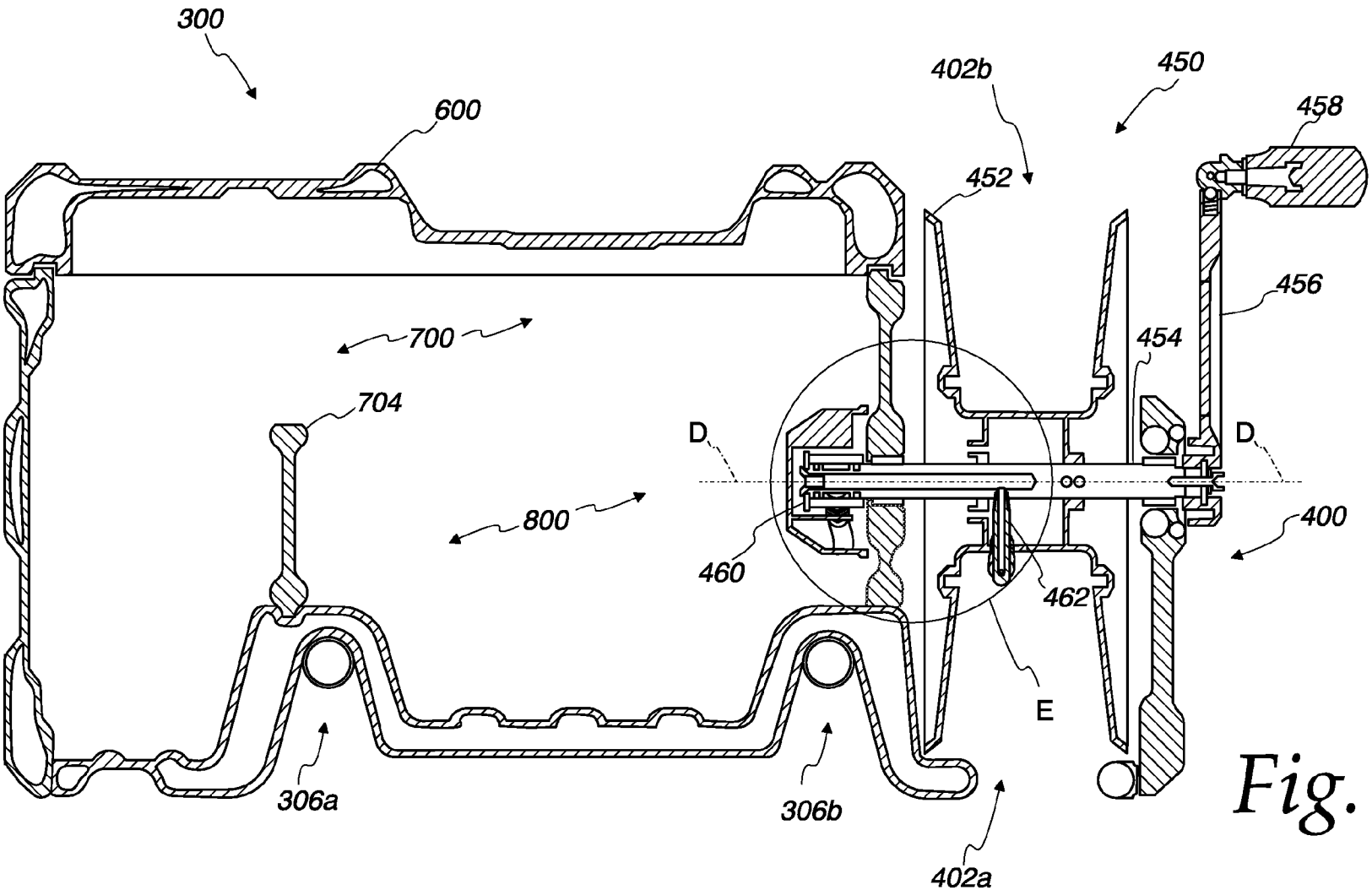
FIG. 8 illustrates a front elevation view, in section taken along line 8-8 shown in FIG. 7, detailing the storage bin and a fluid connection between an interior of the storage bin to a hose adaptor on the take-up reel assembly.

FIGS. 6, 7 and 8 illustrate that the storage bin 300, in this exemplary embodiment, may include a first compartment 700 enclosed or covered by a lid 600. The lid 600 may be pivotably or hingedly attached to the back wall or surface 702 of the first compartment 700. The storage bin 300 and the lid 600 may include snaps or locks 602 which may be utilized to close and/or secure the lid 600 and enclose the first compartment 700. A removable wall or spacer 704 may be utilized within the first compartment 700 to provide additional organization or storage therein. The removable wall 704 may further provide additional structural stability and strength to the first compartment 700 and the overall storage bin 300.

As previously discussed in connection with FIG. 4, the storage bin 300 shown in FIGS. 6 and 7 includes the hose reel support 400 configured to support the take-up reel assembly 450. The take-up reel assembly 450 may be utilized as a portion of a hose management system or scheme. The take-up reel assembly 450 may include the take-up reel 452 mounted on take-up reel shaft 454 and rotatable about an axis D. In particular, the take-up reel shaft 454 (see FIG. 8) supports the take-up reel 452 and can be rotated via a crank handle 456 and a handle 458. The take-up reel shaft 454 may be a substantially hollow shaft configured to fluidly couple the compressor unit 200 to the hose (not shown) rotatably carried by the take-up reel assembly 450. Because the take-up reel shaft 454 is a rotatable shaft, a rotatable fluid coupler 460 may be cooperatively attached thereto to allow a fluid connection to be maintained as the take-up reel shaft 454 rotates. The rotatable fluid coupler 460 may be positioned within, for example, a sub-compartment 800 to provide a fluid path between the compressor unit 200 and the take-up reel assembly 450.

A pigtail or hose connector 604 (see FIG. 6) may provide a fluid connection between the compressor unit 200 and the fluid coupler 460 within the sub-compartment 800. The pigtail 604 may extend from a slot 608 formed in the storage bin 300. The pigtail 604 may be connected to the compressor unit 200 in operation and may be stored within the sub-compartment 800 when not in use. When the pigtail 604 is disconnected and/or stored, the storage bin 300 may be quickly and easily removed from cooperation with the compressor unit 200. Furthermore, when disconnected from the compressor unit 200, the pigtail 604 may be secured or coupled to a free end (not shown) of the hose 606 (see FIG. 6). Alternatively, the slot 608 may be enlarged to allow for additional connections or hoses to be secured therein. In yet another alternative, ports, couplers or other connectors may be provided or affixed to the storage bin 300 allowing the pigtail 604 or other connectors to remain within the first compartment 700 or sub-compartment 800.

The fluid connection may further continue between the fluid coupler 460 and the take-up reel shaft 454 to a fluid connector 462 disposed adjacent to the take-up reel 452. In this way, the hose 606 (see FIG. 6) may be fluidly connected to the pig tail 604 and, in turn, to the compressor unit 200. The pigtail or hose connector 604 may be utilized to provide a quick disconnect or quick release to allow the removal of the storage bin 300. The handle 458, having a storage position (not shown) substantially aligned with the crank handle 456 and a crank position (shown) may cooperate with the crank handle 456 to rotate the take-up reel shaft 454 and attached take-up reel 452 about the axis D.

Figure 9:
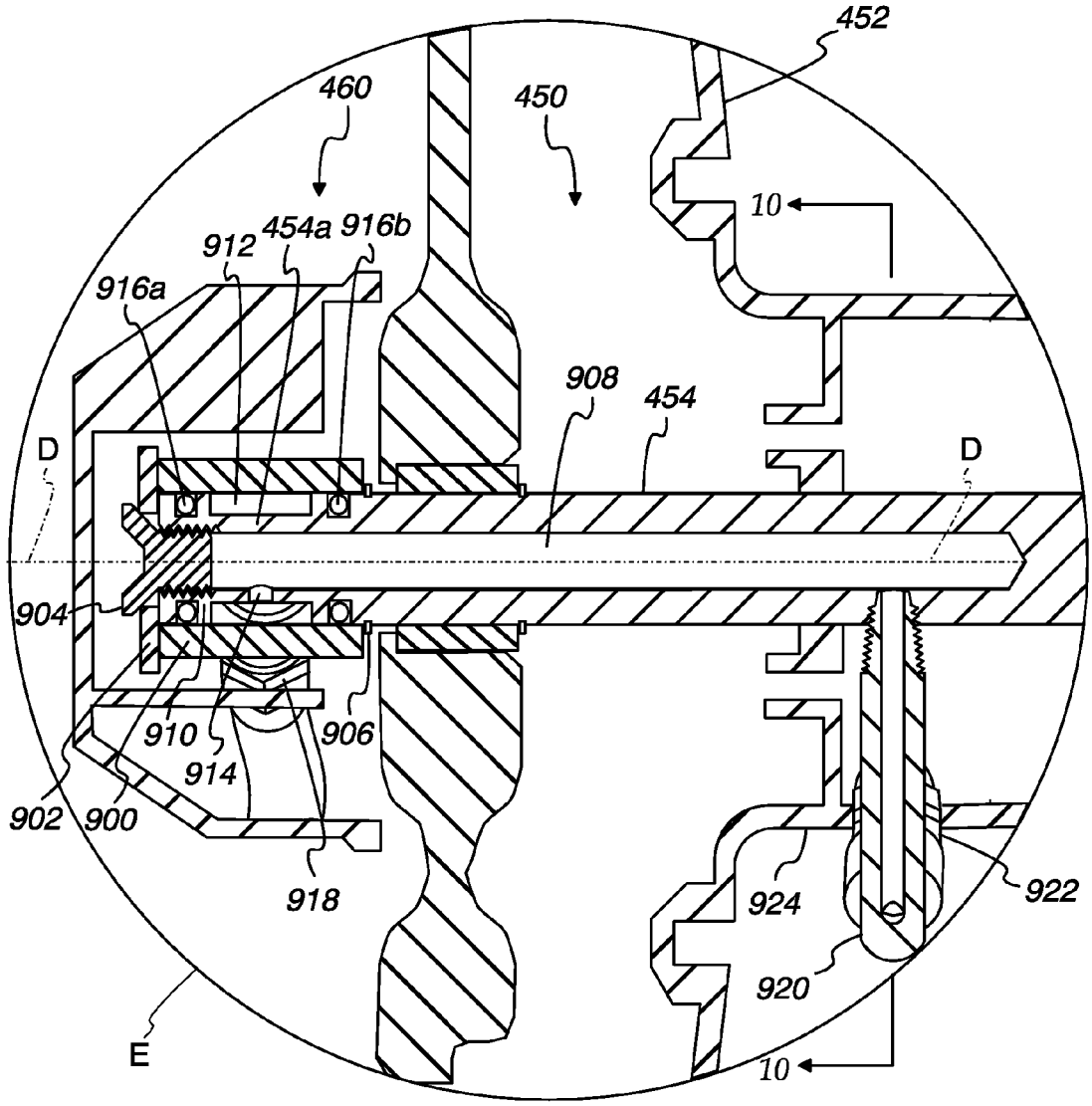
FIG. 9 illustrates an enlarged view of the call-out E shown in FIG. 8, detailing the fluid connection between the interior of the storage bin and the hose adaptor on the take-up reel assembly.

FIG. 9 illustrates an enlarged sectional view indicated by the call-out E shown in FIG. 8. The enlarged sectional view details the fluid connection between the rotatable fluid coupler 460 and the take-up reel assembly 450. As previously discussed, the rotatable fluid coupler 460 may be disposed and carried within the sub-compartment 800. The rotatable fluid coupler 460 may engage and enclose a first end 454*a* of the take-up reel shaft 454. In particular, a sleeve 900 may enclose the first end 454*a* of the take-up reel shaft 454. The sleeve 900 may be secured to the take-up reel shaft 454 utilizing a sealing plate 902 and a releasable fastener 904. A snap-ring 906 may cooperate with the sealing plate 902 and the releasable fastener 904 to ensure that the sleeve 900 remains in a desired position relative to the take-up reel shaft 454.

The take-up reel shaft 454, as previously discussed, may be a hollow shaft that includes a fluid passage 908. The fluid passage 908 may be aligned along and co-linear with the axis D. The take-up reel shaft 454 may further include a reduced diameter portion 910 which cooperates with the sleeve 900 to define a substantially cylindrical air chamber or plenum 912. A through-hole 914 may allow for fluid or air communication between the fluid passage 908 and the air chamber 912. A pair of seals 916*a*, 916*b* such as, for example, O-rings, may be positioned substantially adjacent to the snap-ring 906 and the sealing plate 902, respectively. The pair of seals 916*a*, 916*b* may cooperate with the snap-ring 906 and the sealing plate 902 to prevent the escape of air from within the air chamber 912. A fluid coupler 918 may be carried and sealingly secured to an outer surface of the sleeve 912. The fluid coupler 918 may provide a physical attachment point between the rotatable fluid coupler 460 and the compressor unit 200.

A second fluid connector or coupler 920 may be coupled to the take-up reel shaft 454 and in fluid communication with the fluid coupler 918 via the fluid path 908. The second fluid coupler 920 may be positioned within an inner portion 924 of the take-up reel 452 to provide a connection to any hose 606 (see FIG. 6) carried therein. The fluid couplers 918 and 920 may include a connector 922 such as a quick release, barbed connector or any other connection mechanism capable of providing an air or fluid tight connection.

Figure 10:
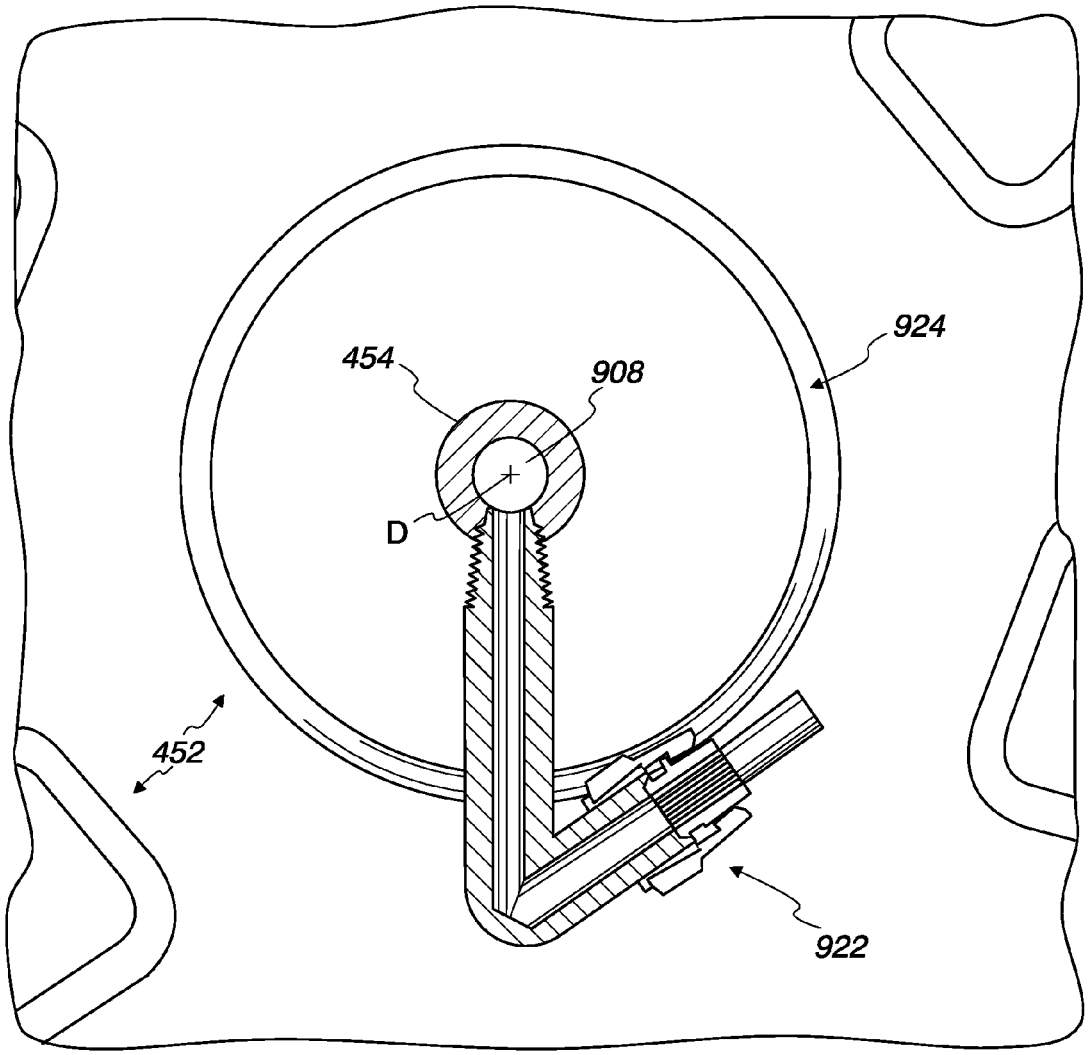
FIG. 10 illustrates a side elevation view, in section taken along line 10-10 of FIG. 9, detailing a fluid connector carried on the take-up reel assembly.

FIG. 10 illustrates a side elevation view, in section taken along line 10-10 shown in FIG. 9, detailing the fluid coupler 920 disposed within the take-up reel 452. The fluid coupler 920 engages and cooperates with the take-up reel shaft 454 to provide a fluid connection between the fluid passage 908 and the connector 922. In one exemplary embodiment, the fluid coupler 920 is shaped or configured to arrange the connector 922 in a position substantially tangential to the inner portion 924 of the take-up reel 452. By positioning the connector 922 adjacent to the inner portion 924, any hose 606 (see FIG. 6) will be encouraged to loop around and/or cooperate with the take-up reel 452 thereby easing and/or simplifying the winding process, and more specifically assists in preventing the hose 606 from kinking.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. An air compressor assembly comprising:

a frame including a lower frame portion and an upper frame portion;

a fluid tank carried by the lower frame portion;

a compressor mechanism carried by the lower frame portion; and a storage bin including a tool-free engagement mechanism, wherein the engagement mechanism is releasably coupled to the upper frame portion, and wherein the tool-free engagement mechanism comprises at least one groove formed in a lower portion of the storage bin and configured to engage the upper frame portion.

2. The air compressor assembly of claim 1 further comprising a telescoping handle coupled to the frame, wherein the telescoping handle is configured to define a retracted position substantially adjacent to the upper frame portion and an extended position.

3. The air compressor assembly of claim 2, wherein the telescoping handle cooperates with a locking mechanism to at least secure the telescoping handle in the extended position.

4. The air compressor assembly of claim 3, wherein the locking mechanism is at least one indexed plunger assembly.

5. The air compressor assembly of claim 1, wherein the tool-free engagement mechanism deformably engages the upper frame portion.

6. The air compressor assembly of claim 1, wherein the storage bin includes a take-up reel assembly.

7. The air compressor assembly of claim 1, wherein the storage bin includes a lid pivotably attached to a back wall.

8. The air compressor assembly of claim 1, wherein the storage bin includes a hose reel support having an open bottom portion.

9. The air compressor assembly of claim 1, wherein the storage bin includes a removable partition.

10. An air compressor assembly having a frame including a lower frame portion and an upper frame portion, a fluid tank carried by the lower frame portion, and a compressor mechanism carried by the lower frame portion, wherein the compressor mechanism is arranged substantially perpendicular to the fluid tank, the air compressor assembly comprising:

a storage bin configured to be releasably coupled to the upper frame portion, the storage bin comprising:

an engagement mechanism disposed on a bottom portion of the storage bin, wherein the engagement mechanism is configured to releasably engage the upper frame portion;

a storage compartment having a lid pivotably attached to a back wall of the storage bin; and a hose reel support having a take-up real assembly rotatably attached to adjacent to a side wall of the storage bin.

11. The air compressor assembly of claim 10, wherein the hose reel support includes an open bottom portion.

12. The air compressor assembly of claim 10, wherein the engagement mechanism deformably engages the upper frame portion.

13. The air compressor assembly of claim 10, wherein the storage compartment includes a removable partition.

14. The air compressor assembly of claim 10, wherein the engagement mechanism comprises at least one groove formed in the bottom portion of the storage bin and configured to engage the upper frame portion of the frame.

15. The air compressor assembly of claim 10, wherein the engagement mechanism is a tool-free engagement mechanism.

* * * * *